US005443272A

United States Patent [19]

Vincent, Sr.

[11] Patent Number: 5,443,272

[45] Date of Patent: Aug. 22, 1995

[54] METHOD AND APPARATUS FOR COVERING ARROW SHAFTS

[76] Inventor: Richard G. Vincent, Sr., 719 E. 8th St., Mesa, Ariz. 85203

[21] Appl. No.: 155,802

[22] Filed: Nov. 22, 1993

[51] Int. Cl.[6] ..... F42B 6/04

[52] U.S. Cl. ..... 273/416

[58] Field of Search ..... 273/416, 423; 128/4; 433/116; 269/38

[56] References Cited

U.S. PATENT DOCUMENTS

| | | | |
|---|---|---|---|
| 1,691,823 | 11/1928 | Ogilvie | 433/116 |
| 1,834,726 | 12/1931 | Ozon | 433/116 |
| 2,782,036 | 2/1954 | Folberth, Jr. | 273/106.5 |
| 2,891,794 | 6/1959 | Meyer | 273/106.5 |
| 3,144,020 | 8/1964 | Zingale | 128/4 |
| 3,853,320 | 12/1974 | Carella | 273/106.5 C |
| 3,865,374 | 2/1975 | Troncosso, Jr. | 273/106.5 R |
| 4,646,722 | 3/1987 | Silverstein | 128/4 |
| 4,856,792 | 8/1989 | Hardison | 273/416 |

FOREIGN PATENT DOCUMENTS

| | | | |
|---|---|---|---|
| 2632288 | 1/1978 | Germany | 273/423 |

*Primary Examiner*—William H. Grieb

*Attorney, Agent, or Firm*—David G. Rosenbaum; Laura J. Zeman

[57] ABSTRACT

A method and apparatus for coloring or increasing the visibility of an archer's arrow is presented. The apparatus comprises a hollow tubular sleeve which is made of a natural or synthetic stretchable rubber or shrinkable plastic. The hollow tubular sleeve is applied to an existing arrow shaft and made or caused to fit snugly to the arrow shaft. Cresting and fletching can then be performed wherein the crests and feathers or vanes may be adhered to either the hollow tubular sleeve or the arrow shaft.

20 Claims, 1 Drawing Sheet

METHOD AND APPARATUS FOR COVERING ARROW SHAFTS

BACKGROUND OF THE INVENTION

The present invention relates generally to a method and apparatus for covering the shaft of an arrow used in the sport of archery. More particularly, the present invention relates to an arrow shaft sleeve that shrinks or stretches to conform to the shape of the arrow shaft. The arrow shaft sleeve may be of any single opaque or translucent color, or a printed pattern such as camouflage to blend with the environment in which it is used. Alternatively, the arrow shaft sleeve may be of a bright color, such as white, yellow, or orange to enhance the visibility of the arrow. In addition, cresting bands may be applied to the arrow shaft sleeve as a personal identification mark.

Arrow shafts are made of a wide variety of materials including wood, aluminum, fiberglass, carbon fiber and carbon fiber covered aluminum. Arrow builders have color coated their arrow shafts for decades to either increase their visibility or enhance their cosmetic appearance. Archers are often concerned with increasing the visibility of their arrows so that they can easily track the flight of their arrow, and later locate them more easily after hitting or missing their target. This becomes particularly advantageous during the early morning and late afternoon, which are typically the best hunting periods. By increasing the visibility of their arrows, hunters can easily track the arrows flight and use that information to determine further action. Other hunters may find it more desirable to have arrows which blend into the background of their hunting location. Target shooters are generally more interested in better arrow visibility so that they can easily see where their arrow struck the target. In addition, arrows that pass through game or miss their target become much easier to find if they are brightly colored.

Dipping is a process currently used by arrow builders to color coat their arrow shafts. To dip an arrow, a paint type liquid is poured into a closed end tube or container. The arrow shaft is then dipped into the tube to the desired depth and then slowly removed. Usually, six to twelve inches of the arrow shaft is coated at the nock end. The nock end is that end of the arrow that engages the bow string. Sometimes, the entire arrow shaft is coated in order to provide maximum visibility. The arrow is then removed from the dip tube and hung in a vertical position to allow any excess paint to run off. The arrow shaft must remain in this position until the coating has dried. After the shaft has dried, the arrow builder will fletch the arrow and, optionally, add cresting marks to the arrow. Fletching is the process of attaching flight stabilizing feathers or vanes to the arrow shaft. Cresting is the process of painting or applying circular bands around the circumference of the arrow shaft in an arbitrary, or distinct pattern.

There are many restrictions and disadvantages associated with dipping arrow shafts. First, dipping involves the use of flammable and toxic materials. Therefore, dipping must be done in a well ventilated area away from any open flames. Second, dipping is messy in that it requires drip cloths and special handling to avoid getting clothes, skin, and work area contaminated with paint. Third, the dipping process is time consuming in that the arrow is not completely dry and ready to be handled for six or more hours after dipping. Fourth, arrow shafts must be dipped before nocking or fletching procedures can be employed. Fifth, craftsman utilizing the dipping process are advised to pre-treat the arrow shafts with an acidic liquid for up to thirty minutes and then to rinse and let them air dry before dipping. Sixth, builders are advised not to touch the surface of the arrow shaft after treating, or before dipping. Seventh, repairing or re-dipping arrows that have been dipped requires scraping and the use of flammable and toxic solvents. Eighth, craftsman can expect poorly finished or unusable arrows if the temperature is below 70 degrees Fahrenheit during the dipping process. Finally, special skills are required to obtain a satisfactory, run free, non-bubbled finish on the arrow shaft.

Accordingly, there is a need for a quick and easy method and device for covering arrow shafts which requires a minimum amount of skill.

SUMMARY OF THE INVENTION

It is an object of the present invention to provide a more efficient and less complicated means for covering or coloring arrow shafts than those current methods known in the prior art.

It is a further object of the present invention to provide an arrow shaft sleeve which shrinks or stretches to snugly fit around the circumference of an arrow shaft.

It is still a further object of the present invention to provide an arrow shaft sleeve that is light weight, non-toxic and safe to use around open flames.

It is yet a further object of the present invention to provide an arrow shaft sleeve that can be used on all known types of arrow shafts.

It is still a further object of the present invention to provide an arrow shaft sleeve which can be easily removed to facilitate repairing or recovering of the arrow shaft.

In brief, there is provided an arrow shaft cover made of a hollow tubular sleeve which slips over an arrow shaft. The sleeve is preferably comprised of a hollow tubular shrink tubing or a stretchable hollow tubular material. In the case of a shrink tubing, the tubing will shrink to fit the arrow shaft by means of heat application, chemical evaporation, or any other process that causes the tube material to conform to the shape of the arrow shaft. Alternatively, an elastic or other type of conformable material, whose inside diameter is less than the outside diameter of the arrow shaft, may be stretched to snugly conform to the arrow shaft.

These and other objects, features and advantages of the present invention will become more apparent to those skilled in the art from the following more detailed description of the preferred embodiment taken with reference to the accompanying drawings.

DETAILED DESCRIPTION OF THE PREFERRED EMBODIMENT

Figure 2:
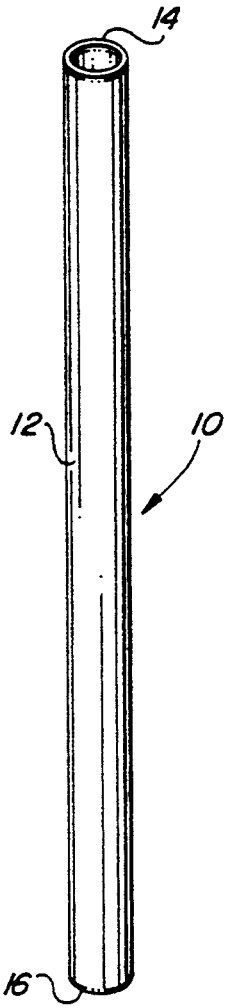
FIG. 2 is a perspective view of an arrow shaft sleeve in accordance with the present invention.

The preferred embodiment of the invention is best illustrated with reference to the accompanying figures. FIG. 2 shows an arrow shaft sleeve 10 in accordance with the present invention. The arrow shaft sleeve 10 comprises a hollow cylindrical tube 12 having a first end 14 and a second end 16.

Figure 1:
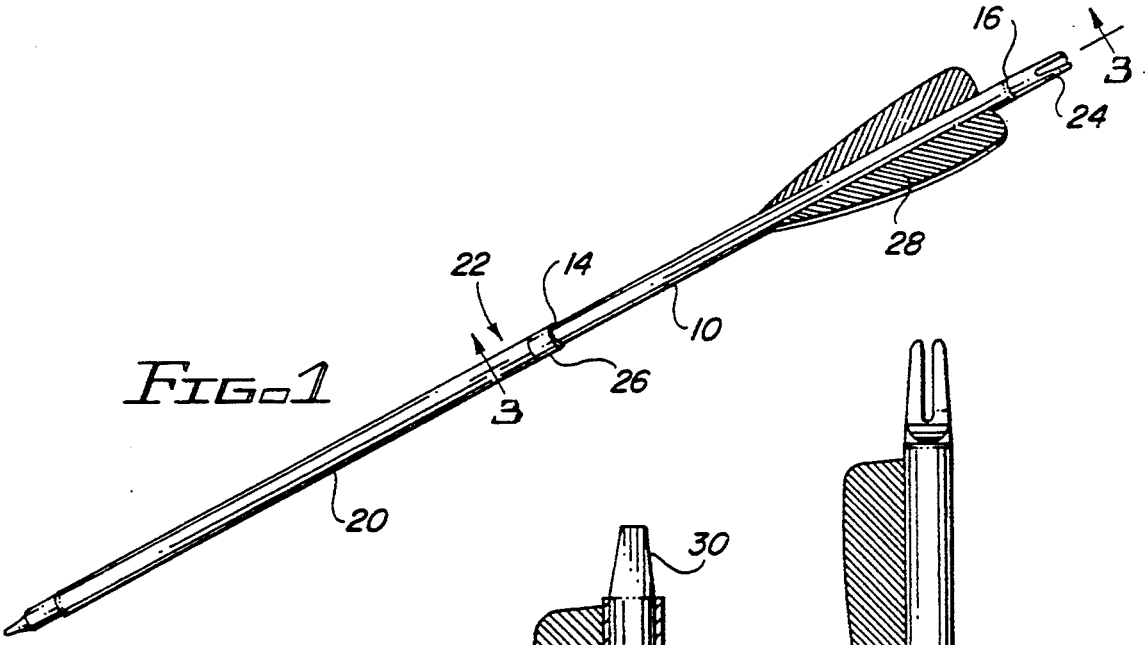
FIG. 1 is a perspective view of an archery arrow which has been fitted with an arrow shaft sleeve in accordance with the present invention.

FIG. 1 illustrates an arrow shaft sleeve 10 in accordance with the present invention which has been shrunk, or stretched to cover the arrow shaft 20 of an arrow 22. The arrow shaft sleeve 10 is preferably made of a heat shrinkable plastic material such as polyvinylchloride (PVC), polyolefin, nylon, or polytetrafluoroethylene, commonly known as PTFE or TEFLON. However, the arrow shaft sleeve 10 may be of any lightweight polymer, plastic, or other material that can shrink to fit by means of heat application, evaporation or other processes which can cause the material to conform to the shape of an arrow shaft 20. Alternatively, materials such as natural rubbers and synthetic rubbers, such as latex, which can stretch to conform to the shape of the arrow shaft 20, may be used in accordance with the spirit of the present invention. In addition, the material which comprises the arrow shaft sleeve 10 may be of various colors, prints, and opaqueness.

The method of covering the arrow shaft 20 with an arrow shaft sleeve 10 of the present invention is neat, simple, and efficient. The arrow shaft sleeves may be provided in standard lengths or, alternatively, one long length of tubing may be provided in a rolled or other prepackaged form to enable a user to measure and cut the desired length of tubing needed for a particular arrow shaft. Preferably, the arrow shaft sleeve 10 is at least six inches long.

The arrow shaft sleeve 10 can be brightly colored to enable high visibility in an outdoor or low light environment. Alternatively, the arrow shaft sleeve 10 may have a camouflage pattern and/or a dull finish to meet a hunters desire to blend into the colors or patterns of the surrounding environment. To cover the arrow, the arrow shaft sleeve 10 is preferably slid or stretched over the arrow shaft 20 of the arrow 22 so that the arrow shaft sleeve 10 slightly overlaps the nock 24. This position creates a smooth transition slope from the arrow shaft 20 to the nock 24 thereby allowing the arrow 22 to pass easily over the arrow rest of the archer's bow. Arrow nocks are well known in the art and are attached to the end of the arrow which comes into contact with the bow string. Nocks are typically made of a molded plastic body having one end which is glued to the arrow shaft 20 and another end which contains a notch for receiving a bow string. The nock 24 is preferably, although not necessarily, attached to the arrow shaft 20 prior to installing the arrow shaft sleeve 10 over the arrow shaft 20.

Where a shrinkable material is used for the arrow shaft sleeve 10, the material is then allowed or caused to shrink until it snugly conforms to the arrow shaft 20. Shrinkable materials that are designed to shrink by means of evaporation will do so upon exposure to ambient air. Shrinkable materials that require a heat source to enact the shrinking process may be shrunk by using the heat from a standard 1500 watt hair dryer or electric stove top burner. In the field, an archer may use the heat from the coals of fire to cause heat shrinkable arrow sleeves to conform to the arrow shaft 20. Any uneven edges of either the shrinkable or stretchable material may be evened up at the ends 14,16 of the arrow shaft sleeve 10 with a common single edged razor blade.

Finally, cresting and fletching procedures can be performed on the arrow 22. As shown in FIG. 1, cresting bands 26 have been applied to the arrow shaft sleeve 10. Cresting bands may be applied at any point or points along the arrow shaft sleeve 10, or the arrow shaft 20. Fletching, the process of applying feathers or vanes to the arrow shaft sleeve 10, can be performed before or after the cresting bands 26 have been applied. If cresting bands 26 are to be applied to the arrow shaft sleeve 10 in the area where feathers or vanes 28 are to be applied, the cresting bands 26 must be applied prior to the application of feathers or vanes 28. Vanes 28 can be affixed to the arrow shaft sleeve 10 using regular or instant glues commonly used in the art.

A very distinct advantage of the arrow shaft sleeves will be experienced by users that do not have the tools or skills to fletch their arrows. With pre-fletched arrows, users can install an arrow shaft sleeve 10 from the tip end of the arrow 22 and position it at the tip end of the feathers or vanes 28. The versatility of the arrow shaft sleeve 10 allows the user the ability to take advantage of colored arrows without the need to have his pre-made arrows disassembled.

Figure 3:
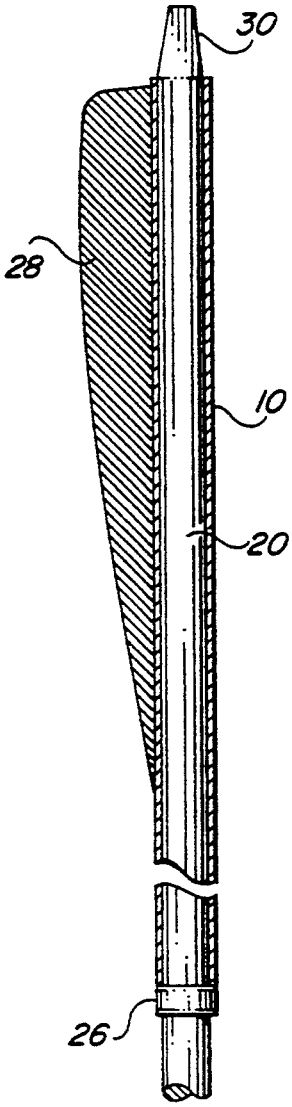
FIG. 3 is a cross sectional view taken along line 3—3 of FIG. 1 with the nock removed from the nock end of the arrow.

A cross section taken along line 3—3 of FIG. 1 is shown in FIG. 3. The nock 24 is shown removed to illustrate the tapered end 30 commonly found on the arrow shaft 20 for the purpose of proper positioning of the nock 24 to the arrow 22. An arrow shaft sleeve 10 has been snugly fitted to the arrow shaft 20. A crest 26 has been applied to the arrow shaft sleeve 10 at the first end 14 of the arrow shaft sleeve 10. Vanes 28 are shown adhered to the arrow shaft sleeve 10.

Figure 4:
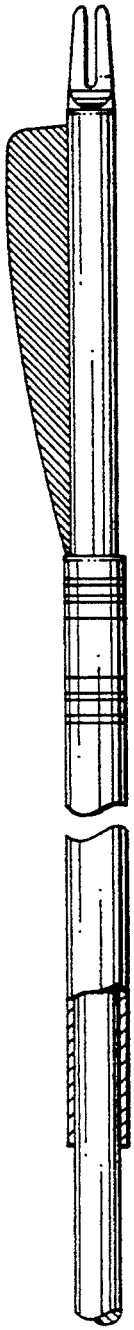
FIG. 4 is a top elevational view of an archery arrow fitted with an arrow shaft sleeve in accordance with the present invention, wherein the arrow shaft sleeve is positioned between the vane and tip of the arrow.

FIG. 4 illustrates an arrow shaft sleeve 10 which is snugly fitted to an arrow shaft 20, and positioned on the arrow shaft 20 between vanes 28 which have been adhered to the arrow shaft 20 and the tip of the arrow 22. Subsequent to fitting the arrow shaft 20 with the arrow shaft sleeve 10, cresting bands were painted on the arrow shaft sleeve 10. This positioning of the arrow shaft sleeve 10 on the arrow shaft 20 enables an archer to quickly change the color and markings on the arrow shaft 20 without re-fletching the arrow 22.

The process of applying the arrow shaft sleeve 10 to the arrow shaft 20 is more efficient, and less time consuming, than performing the traditional dipping method. Furthermore, the arrow shaft sleeve process is environmentally friendlier, eliminates user exposure to toxic chemicals or vapors and requires less skill. Whereas the dipping method is most commonly performed by skilled professionals, the arrow shaft sleeve process affords the common individual the opportunity to achieve professional results with minimal skills and equipment, and virtually no exposure to hazardous chemicals and vapors. In addition, because of its simplicity and lack of conditional restrictions, the arrow shaft sleeve 10 can be applied in the field just as easily as in the workshop.

The easy removeability of the arrow shaft sleeve 10 of the present invention is particularly advantageous over the prior art. If the arrow shaft sleeve 10 becomes damaged during use, or if an archer simply desires to change the color of his feathers or vanes 28 or the crest 26, the arrow shaft sleeve 10 can be easily slit down its length with a knife or razor blade and removed in one piece. Unlike the dipping method which requires scrapping and the use of toxic and flammable chemicals to repair the arrow shaft 20, reworking the arrow 22 using the arrow shaft sleeve 10 is easy, fast and humanly and environmentally safe. As soon as the old arrow shaft sleeve 10 is removed, another can immediately be applied.

It will be apparent to those skilled in the art, that the foregoing detailed description of the preferred embodiment of the present invention is representative of a type of arrow shaft sleeve and method of coloring an arrow shaft, within the scope and spirit of the present invention. Further, those skilled in the art will recognize that various changes and modifications may be made without departing from the true spirit and scope of the present invention. For that reason, the scope of the present invention is set forth in the following claims.

I claim:

1. An arrow shaft sleeve for covering an arrow shaft having a tip end, a tail end and a middle portion located between said tip and tail ends, said arrow shaft sleeve comprising a one-piece hollow tubular sleeve of substantially overall equal wall thickness, being open at both ends for receipt of said arrow shaft, and extending over approximately one-third of a length of said arrow shaft such that said arrow shaft sleeve covers a substantial portion of the middle portion of said arrow shaft.

2. The arrow shaft sleeve of claim 1 wherein said hollow tubular sleeve comprises at least one of a shrink tubing and stretchable tubing.

3. The arrow shaft sleeve of claim 2 wherein said hollow tubular sleeve comprises at least one of an opaque color, a transparent color, a single color design, and a multi-color design.

4. The arrow shaft sleeve of claim 2 wherein said hollow tubular sleeve is comprised of at least one of a light weight polymer, a plastic, a natural rubber, and a synthetic rubber.

5. The arrow shaft sleeve of claim 2 wherein said hollow tubular sleeve is comprised of at least one of a polyolefin, a polyvinylchloride, a polytetrafluoroethylene, a nylon, a kynar, and a latex.

6. The arrow shaft sleeve of claim 3 wherein said hollow tubular sleeve is comprised of at least one of a light weight polymer, a plastic, a natural rubber, and a synthetic rubber.

7. The arrow shaft sleeve of claim 3 wherein said hollow tubular sleeve is comprised of at least one of a polyolefin, a polyvinylchloride, a polytetrafluoroethylene, a nylon, a kynar, and a latex.

8. The arrow shaft sleeve of claim 5 wherein said hollow tubular sleeve has at least one of uniform shrinking characteristics and uniform stretching characteristics so that the arrow shaft sleeve can fit snugly over the arrow shaft.

9. The arrow shaft sleeve of claim 7 wherein said hollow tubular sleeve has at least one of uniform shrinking and uniform stretching characteristics so that the arrow shaft sleeve can fit snugly over the arrow shaft.

10. An archer's arrow comprising:

an elongated shaft having first and second ends, and a middle portion located between said first and second ends, said first end having a sharp point;

a nock attached to the second end of said shaft; and a hollow tubular sleeve which fits over said shaft extending from said second end of said shaft along approximately one-third of a length of said elongated shaft such that said hollow tubular sleeve covers a substantial portion of the middle of said elongated shaft.

11. The archer's arrow of claim 10 wherein said hollow tubular sleeve comprises at least one of a shrink tubing and a stretchable rubber tubing.

12. The arrow shaft sleeve of claim 11 wherein said hollow tubular sleeve comprises at least one of an opaque color, a transparent color, a single color design, and a multi-color design.

13. The archer's arrow of claim 12 wherein said arrow further comprises a crest band adhered to at least one of said hollow tubular sleeve and said arrow shaft.

14. The archer's arrow of claim 12 wherein said arrow further comprises fletching adhered to at least one of said hollow tubular sleeve and said arrow shaft.

15. The archer's arrow of claim 12 wherein said hollow tubular sleeve is comprised of at least one of a light weight polymer, a plastic, a natural rubber, and a synthetic rubber.

16. The archer's arrow of claim 12 wherein said hollow tubular sleeve is comprised of at least one of a polyolefin, a polyvinylchloride, a polytetrafluoroethylene, a nylon, a kynar, and a latex.

17. The arrow shaft sleeve of claim 16 wherein said hollow tubular sleeve has at least one of uniform shrinking characteristics and uniform stretching characteristics so that the arrow shaft sleeve can fit snugly over the arrow shaft.

18. A method for coloring the shaft of an archery arrow, said archery arrow having a tip end, a tail end, and a middle portion located between said tip and tail ends, said method comprising the steps of:

sliding a shrinkable hollow tubular sleeve over approximately one-third of a length of the arrow shaft such that said shrinkable hollow tubular sleeve covers a substantial portion of the middle of said arrow shaft, said shrinkable hollow tubular sleeve comprising at least one of an opaque color, a transparent color, a single design, and a multi-color design so that the shrinkable hollow tubular sleeve thereby changes the arrow shaft's visible identification; and shrinking said shrinkable hollow tubular sleeve such that said sleeve fits snugly over said arrow shaft.

19. A method for coloring the shaft of an archery arrow comprising the step of pulling a stretchable hollow tubular sleeve over the arrow shaft such that said stretchable hollow tubular sleeve fits snugly over said arrow shaft, wherein said stretchable hollow tubular sleeve comprises at least one of an opaque color, a transparent color, a single color design, and a multi-color design.

20. A method for coloring the shaft of an archery arrow comprising the step of unrolling a stretchable hollow tubular sleeve over the arrow shaft such that said stretchable hollow tubular sleeve fits snugly over said arrow shaft, wherein said stretchable hollow tubular sleeve comprises at least one of an opaque color, a transparent color, a single color design, and a multi-color design.

* * * * *